United States Patent [19]

Dech et al.

[11] Patent Number: 4,762,186

[45] Date of Patent: Aug. 9, 1988

[54] MEDIUM CURVATURE DIRECTIONAL DRILLING METHOD

[75] Inventors: James A. Dech, Plano; David D. Hearn, Richardson; Frank J. Schuh, Plano; John H. Stiegler; Richardson, all of Tex.

[73] Assignee: Atlantic Richfield Company, Los Angeles, Calif.

[21] Appl. No.: 927,780

[22] Filed: Nov. 5, 1986

[51] Int. Cl.[4] ..... E21B 7/08

[52] U.S. Cl. ..... 175/61; 175/76

[58] Field of Search ..... 175/61, 62, 73, 76, 175/320, 325; 166/117.5, 117.6, 242

[56] References Cited

U.S. PATENT DOCUMENTS

| | | | |
|---|---|---|---|
| 2,877,062 | 3/1959 | Hall et al. | 175/325 |
| 3,563,323 | 2/1971 | Edgecombe | 175/76 |
| 4,428,441 | 1/1984 | Dellinger | 175/325 |
| 4,431,068 | 2/1984 | Dellinger et al. | 175/61 |
| 4,523,652 | 6/1985 | Schuh | 175/61 |
| 4,674,580 | 6/1987 | Schuh et al. | 175/325 |

FOREIGN PATENT DOCUMENTS

| | | | |
|---|---|---|---|
| 3101060 | 7/1982 | Fed. Rep. of Germany | 175/325 |

*Primary Examiner*—Stephen J. Novosad

*Assistant Examiner*—Terry Lee Melius

*Attorney, Agent, or Firm*—Michael E. Martin

[57] ABSTRACT

Medium curvature deviated wellbores having a radius of curvature in the range of 200 feet to 400 feet are drilled with downhole drilling assemblies for drilling the curved wellbore portion and for correcting or holding the horizontal wellbore portion and which are connected to the end of a drillstem made up of elongated elastically bendable drillstem members which may be cyclically compressively stressed during rotation of the drillstem. The elastically bendable drillstem members are characterized by joint forming portions at opposite ends of an elongated tubular body and which are of a diameter which minimizes the tendency for the drillstem to buckle during drilling. Spaced apart stress bearing sleeves are attached to or integrally formed with the tubular body and are of a diameter greater than the body and preferably equal to the diameter of the tool joint portions. The drillstem is made up of the elastically bendable compressive service drillstem members extending through the curved and horizontal portions of the wellbore and heavy walled drill pipe or drill collars are provided in the drillstem in the vertical hole portion to impose compressive loads on the drillstem through the curved portion of the wellbore.

5 Claims, 2 Drawing Sheets

MEDIUM CURVATURE DIRECTIONAL DRILLING METHOD

BACKGROUND OF THE INVENTION

1. Field of the Invention

The present invention pertains to a method and system for directional drilling of wellbores wherein the wellbore deviates from a substantially vertical portion of the wellbore to a substantially horizontal portion through a radius in the range of approximately 200 feet to 400 feet or a so-called build curvature of approximately 15° to 25° per 100 feet of wellbore length.

2. Background

A large number of hydrocarbon containing earth formations exist in various parts of the world which have a vertical thickness of about 300 feet to 400 feet or more. Many of these reservoirs are of a relatively low permeability type rock, such as limestone, and may have a substantial number of spaced apart natural vertical fractures. These types of formations or reservoirs are more likely to be economically produced if the wellbore is formed to extend generally horizontally through the formation to increase the amount of hole "depth" within the formation itself. Accordingly, forming such wellbores desirably involves drilling a vertical portion of the wellbore extending downward from the surface then curving the wellbore into a relatively highly deviated or near horizontal direction within and through the formation itself. It is also generally desirable that the radius of the deviated section of the wellbore which extends from the vertical to the horizontal portion be in the range of about 200 feet to 400 feet. In this way drilling may take place to identify the formation thickness, the wellbore may be plugged back to the top of the production zone or blocked by a whipstock of the like and then redrilled to form the transition portion from the vertical to the near horizontal. The curved and horizontally extending wellbore portions should be left in an open hole condition, if possible, to maximize wellbore length available for production of mineral values.

Unfortunately, up to the time of the development of the present invention, known techniques for drilling highly deviated or generally horizontal wellbores fall into categories which are rather extreme with respect to the desired wellbore configurations for producing the types of formations mentioned. So called conventional deviated drilling techniques for transforming the wellbore from a vertical to generally horizontal direction use conventional rotary drilling equipment and methods wherein the radius of curvature of the drillstem generally cannot be reduced to less than about 1000 feet to 1200 feet and may range upward to a radius of 3000 feet. Such drilling techniques may make it impossible to drill cost effective wells into productive zones having a thickness in the ranges abovementioned.

The other technique used for drilling generally horizontal wellbores is sometimes referred to as drainhole drilling wherein deviation of the wellbore from the vertical to horizontal is through a rather small radius or high build curvature. High curvature drilling to provide drainholes and the like typically is carried out with a curvature radius of about 30 feet which produces a so-called wellbore angular build rate in the range of about 200° per 100 foot of wellbore length. The total length of horizontal or deviated hole that may be produced by such a technique is typically in the range of about 100 feet to 500 feet. The drilling equipment is required to be very specialized and, accordingly, the cost per unit length of horizontal or deviated hole is relatively high.

One rather important consideration in high curvature drilling techniques is the lack of control of the direction of the horizontal portion of the borehole. The high angular build rate is not conducive, with known equipment, to good directional control and the prospect of equipment failure makes this type of curved or deviated hole drilling relatively unattractive.

Accordingly, considering the type and thickness of many known mineral value reservoirs which may be produced, there has been a continuing need to develop deviated or directional drilling methods which will provide the medium curvature geometry of the wellbore desired and which will overcome the disadvantages of conventional deviated hole drilling and so-called high curvature horizontal or drainhole type drilling techniques. It is to this end that the present invention has been developed with the discovery and development of a unique method and an improved drillstem system for drilling medium curvature wellbores with particular but not exclusive emphasis on wellbores drilled with curvatures in the range of approximately 15° to 25° per 100 feet of wellbore length or a wellbore radius of about 200 feet to 400 feet.

SUMMARY OF THE INVENTION

The present invention provides an improved method and system for drilling wellbores which have a curved portion with a radius of curvature which provides for extending the wellbore through pay zones having a total thickness in the range of about 200 feet to 400 feet. In accordance with an important aspect of the present invention, medium curvature wellbores may be drilled utilizing a unique arrangement of drillstem components and including an improved type of drillpipe extending through the curved portion of the wellbore. The drillstem is operated with compressive stresses exerted on the drillpipe and wherein the drillpipe may be rotated as needed in order to perform the drilling function in a desired direction.

In accordance with another important aspect of the present invention, a method of drilling deviated or curved wellbores having a radius of curvature in the range of about 15° to 25° per 100 feet of wellbore length, but not specifically limited to this range, is provided wherein the drillstem is operated with downthrust exerted on the drillstem in such a way that the portion of the drillstem extending through the curved portion of the wellbore is biased toward the radially outermost wall of the wellbore and the drillstem is operated throughout substantially all of its length with compressive loading thereon. In this way, the tendency for forming an irregular wellbore cross-sectional configuration, known in the art as "keyseating", is minimized and chances of the drillstem becoming stuck in the wellbore are reduced.

In accordance with yet another aspect of the present invention, a method and drillstem system for drilling medium curvature wellbores is provided wherein relatively heavy drillstem components are utilized to provide downthrust on the drillbit and outward bias on the curved portion of the drillstem. The so-called heavy drillstem components, sometimes known as thickwalled drillpipe and drill collars, are maintained in the substantially vertical portion of the wellbore to provide the downthrust on the bit without significantly increasing the drillstem rotary turning effort, since the heavier components do not forcibly engage the sidewall of the wellbore to increase drag on the drillstem. In particular, the improved drillstem system includes a compressive service drillpipe of a unique construction which is tolerant of large axial compressive stresses and relatively high curvature or bending to be imposed on the drillpipe while minimizing the amount of increased rotational effort required to be exerted on the drillstem and also alleviating the tendency for the drillpipe to buckle under compressive loads.

The abovementioned features and advantages of the present invention, together with other superior aspects thereof will be further appreciated by those skilled in the art upon reading the detailed description which follows in conjunction with the drawing.

DETAILED DESCRIPTION OF PREFERRED EMBODIMENTS

Figure 1:
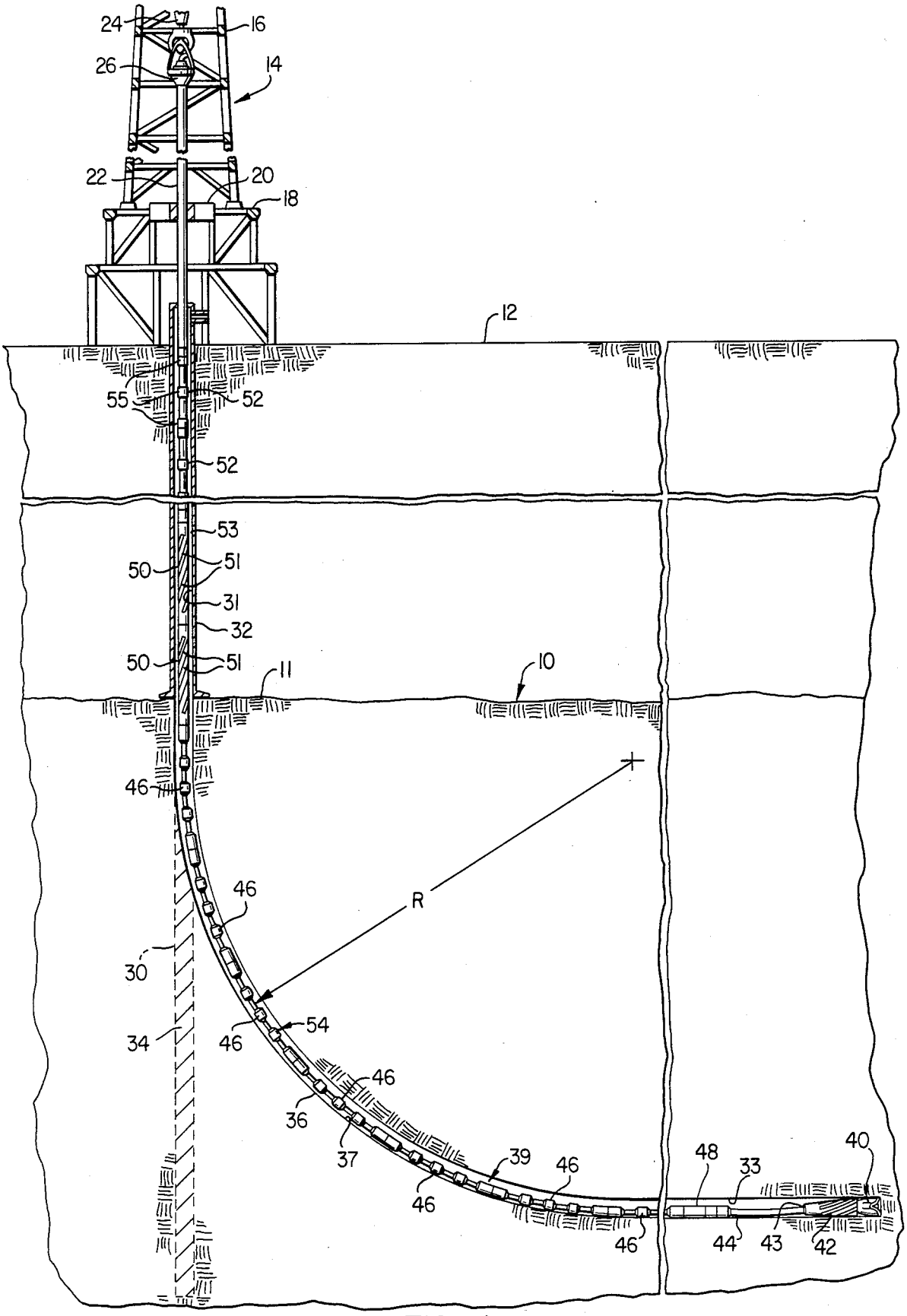
FIG. 1 is a vertical section view, in somewhat schematic form, of a medium curvature wellbore drilling system in accordance with the present invention.

In the description which follows, like parts are marked throughout the specification and drawing with the same reference numerals, respectively. The drawing figures are not necessarily to scale and certain features of the invention may be shown in somewhat schematic form in the interest of clarity and conciseness.

Referring to FIG. 1, there is illustrated an improved medium curvature drilling system for drilling a curved wellbore into a subterranean formation generally designated by the numeral 10. The formation 10 typically has a pay zone thickness in the range of about 400 feet and may lie several hundred or several thousand feet below the earth's surface 12. The drilling system of the present invention may utilize generally conventional surface equipment including a conventional rotary drilling rig 14 having a mast 16 and a conventional substructure 18 for supporting, for example, a rotary table 20. A conventional rotary drive member or kelly 22 extends through the rotary table 20 and is suspended from a traveling block 24 by a swivel 26. The swivel 26 may also be configured to have rotary drive means and be supported in such a way whereby the drillstem component 22 may be driven from its upper end rather than through the rotary table 20.

In drilling a curved wellbore into the formation 10 a conventional, substantially vertical wellbore 30 may be first drilled through the formation 10 to determine its characteristics and overall thickness. When the upper boundary 11 of the formation 10 is located, the wellbore 30 may be cased with a casing string 32, if not previously required, and a cement plug 34 provided back to the boundary 11 so that the deviated or curved portion of the wellbore may be formed.

In the view of FIG. 1, a curved wellbore has been formed which extends from a generally vertical wellbore portion 31 to a generally horizontally extending wellbore portion 33 through a curved portion 36. The curved portion 36 of the wellbore and the generally horizontally extending portion 33 are shown in an "open hole" condition which, typically, may be provided when drilling in relatively low permeability consolidated formations. One of the principal advantages of the method and system of this invention is the provision of extended wellbore length in an openhole condition thanks to the medium radius configuration. In accordance with the improved method and drilling system of the present invention, the radius R of the curved portion 36 of the wellbore may be predetermined to be in the range of approximately 200 feet to 400 feet so that the wellbore may extend through and remain within the formation region 10. The radius R does not have to be constant throughout the curved portion of the wellbore, that is, curvatures which are not true circular arcs may be provided as long as the change in direction of the wellbore accomplishes the objective of maintaining the wellbore in the desired zone.

In the view of FIG. 1, the wellbore has been extended into the horizontal direction to form the horizontal portion 33 and a complete drillstem assembly utilized during this mode of drilling is illustrated in the drawing figure. While drilling the horizontal wellbore portion 33 to extend the length of wellbore in the formation region 10 continued extension of the horizontal portion of the wellbore may be carried out using one of several types of hole forming apparatus such as a so-called rotary "hold" tool comprising a conventional rotary bit 40 which is attached to a elongated generally conical stabilizer body 42 having a tapered outer wall surface which tapers axially from the end adjacent the bit 40 to the opposite end 43 wherein it is connected to a generally flexible section of drill pipe 44. The flexible pipe section 44 is connected to a portion of the drillstem made up of end to end connected sections of drillpipe 46 of a unique type to be described in further detail herein. The drillpipe sections 46 are disclosed and claimed in U.S. Pat. No. 4,674,580 issued June 23, 1987 to Frank J. Schuh and David D. Hearn and assigned to the assignee of the present invention.

The drillpipe sections 46 make up a major portion of the drillstem assembly extending through the horizontal portion 33 of the wellbore and the curved portion 36. A directional survey unit 48 may be interposed in the drillstem to assist in determining the direction of extension of the wellbore portion 33. The directional survey unit 48 may be of a type commercially available from sources such as Gearhart Industries, Inc., Fort Worth, Texas, or Teleco Oil Field Services, Inc., of Lafayette, Louisiana. Accordingly, the drillstem system 39 illustrated, while forming the generally horizontal wellbore portion 33, is made up of a direction maintaining assembly such as the bit 40 and the stabilizer collar 42 and a plurality of end to end connected drillpipe sections 46 which extend through the horizontal wellbore portion 33 and the curved wellbore portion 36. Alternatively, the direction maintaining or "hold" tool assembly can be replaced by a steerable downhole drill motor of a type available commercially from Norton Christiansen, Inc., Salt Lake City, Utah.

The remainder of the drillstem system 39 in the vertical wellbore portion 31 advantageously includes end to end connected relatively heavy drillstem sections 50, commonly known as drill collars. The drill collars 50 are relatively stiff and thick-walled drillstem sections which have a substantially greater weight per unit length than the drillpipe sections 46. Preferably, the drill collars 50 include spiral grooves 51 formed on the outer surfaces thereof to minimize differential pressure effects due to the flow of drilling fluids within the annulus 53 formed between the drillstem and the wellbore wall surface. Near the upper end of the drillstem assembly or system 39 and below the uppermost drillstem member, such as the kelly 22, additional end to end connected drillstem sections 52 are provided and which may comprise additional collars 50 or may comprise other so-called thickwalled drillpipe. The drillstem sections 52 are those having a conventional elongated tubular stem portion and somewhat enlarged diameter end portions on which are formed external and internal threads, respectively, for coupling the drillstem sections in end to end relationship. The drillstem sections 52 may include a plurality of spaced apart collar portions 55 which add weight to the drillstem sections. Accordingly, the portion of the drillstem system 39 disposed in the generally vertical wellbore portion 31 is heavier per unit length than that portion formed by the drillstem sections 46. Even through the drillstem sections 50 and 52 are not necessarily of uniform density throughout their length, the overall average weight per unit length of the drillstem portion above the curved wellbore is greater than that which is in the curved and horizontal wellbore. U.S. Pat. No. 4,431,068 to T. B. Dellinger et al describes a drilling method wherein heavier drillstem sections are provided in the vertical wellbore portion of a deviated or curved wellbore.

In accordance with a preferred method of drilling a medium curvature wellbore in accordance with the present invention, the relatively heavy portions of the drillstem system or assembly 39, including the drill collars 50 and the drillstem sections 52, are also interposed in the drillstem in such a way that they remain in the generally vertical portion of the wellbore 31. In this way, an improved method is provided wherein a downward or axial thrust force is exerted on the drillstem toward the bit 40 which deflects the drillstem portion, generally designated by the numeral 54, in the curved wellbore portion 36 toward the radially outermost wall 37 of the wellbore portion 36 during drilling operations. By forcing the drillstem against the outer wall 37 of the wellbore portion 36, the drillstem does not tend to cut into the inside portion of the wellbore wall to form a groove therein which can interfere with insertion and removal of the drillstem. This problem with prior art curved drilling practices is aggravated in relatively high curvature wellbores and wherein the drillstem is held in tension to control the weight on the drillbit.

By maintaining the weight adding heavy or thickwalled drill pipe such as the drillstem sections 52 and the drill collars 50 in the vertical portion 31 of the wellbore, as illustrated in FIG. 1, and by employing the unique drillstem portion made up of the drillpipe sections 46 in the curved and generally horizontal portion of the wellbore, the curved portion of the drillstem may be compressively stressed and the heavier drillstem components are not in engagement with the wall surfaces forming the horizontal or curved portions of the wellbore. Avoidance of this latter mentioned condition minimizes the drag on the drillstem created by heavy drillstem sections if they are located near the drillbit as in conventional drilling. The unique drillpipe sections 46 used in the drillstem system 39 between the vertical portion of the wellbore and the "bottom" of the wellbore are adapted to withstand cyclic bending stresses during rotation of the drillstem, prevent spiral or helical buckling due to the torque imposed on the drillstem during rotation thereof, and to withstand the compressive forces exerted on the drillstem by the weight of the portion of the drillstem extending through the vertical wellbore portion 31.

Figure 3:
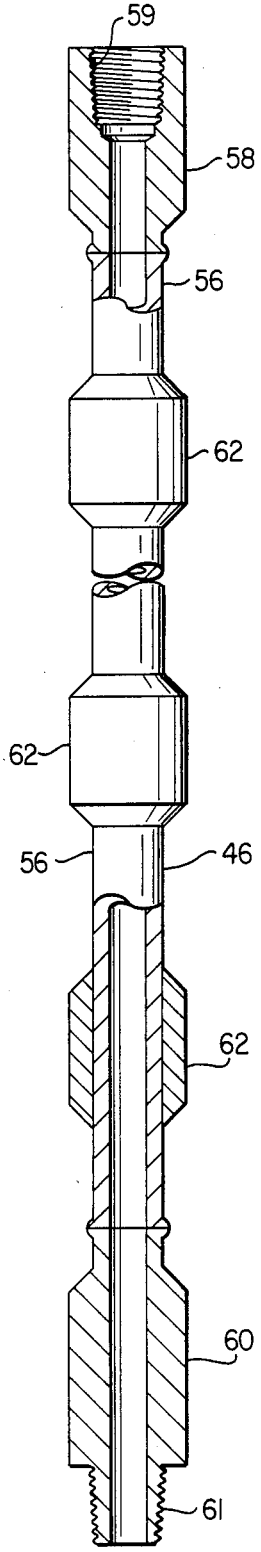
FIG. 3 is an elevation view of an improved drillstem member particularly adapted for use with the drillstem shown in FIG. 1.

It has been determined that a drillstem component such as one of the drillpipe sections 46 may be provided of reduced diameter through a major portion of its length and of reduced wall thickness to accommodate the bending stresses imposed thereon by providing each of the sections with a plurality of spaced apart sleeves, sometimes called "dummy tool joints". Referring now to FIG. 3, by way of example, there is illustrated one of the drillpipe sections 46 which is characterized by an elongated hollow tubular member 56 having integral or joined end portions 58 and 60 at opposite ends thereof and of a larger diameter than the member 56. The tool joint end portions 53 and 60 are respectively provided with internal threads 59 and external threads 61 forming so-called box and pin portions of the drillpipe section 46. A plurality of cylindrical collars or stress sleeves 62 are formed on the member 56 and are preferably spaced apart equally along the member between the tool joint portions 58 and 60. The sleeves 62 may be integrally formed with the member 56 or may be fabricated as split half-cylindrical sections which can be joined to the member or body 56 or can be slipped thereon before the joint portions 58 and 60 are joined to the body 56. The number of sleeves 62 required to reduce the bending stresses to an acceptable level will vary depending on factors such as the diameter of the member or body 56, the maximum curvature to which the drillpipe sections 46 are exposed and the overall compressive or axial loading on the drillstem assembly. It is important that the outer diameter of the sleeves 62 be such in relation to the diameter of the wellbore as to minimize the chance of helical buckling of the drillpipe sections.

The sleeves 62 act as supports for the drillpipe sections 46 when the drillstem is in engagement with the sidewalls of the wellbore, such as the wall 37 as illustrated in FIG. 1. A more detailed discussion of the so-called compressive service drillpipe sections 46 is provided in the aforementioned U.S. Pat. No. 4,674,580 to Frank J. Schuh and David D. Hearn. By way of example, drillpipe sections 46 designed for drilling a 6.0 inch to 6.50 inch diameter wellbore may be of approximately 30 feet overall length and have a nominal weight per foot of length of 10.40 pounds and 13.30 pounds, respectively. The lighter weight pipe described above has a nominal outside diameter of 2.88 inches for the member 56 and with an outside diameter of 5.0 inches for the tool joint sections 58 and 60 and the sleeves 62. The spacing of the sleeves 62 may be at 7.5 foot intervals. A somewhat stiffer pipe having an outside diameter of 3.50 inches for the member 56 also has tool joint sections 58 and 60 and sleeves 62 of 5.0 inches outside diameter with the spacing of the sleeves 62 being at approximately 10.0 foot intervals. The sleeves 62 advantageously provide for distribution of the bending loads on the drillstem sections 46 relatively evenly along the length thereof, prevent the body 56 from contacting the wellbore, and reduce the bending stress on the body 56. The total torque or turning effort to be exerted on the drillstem is also reduced due to reduced viscous effects and differential pressure effects acting on the drillstem.

In a preferred method of forming a medium curvature wellbore such as the wellbore 31, 36, 33, illustrated in FIG. 1, if the formation region 10 requires logging to determine its location and total depth, a generally vertical wellbore 30 is first drilled using conventional drilling techniques and equipment so that the upper and lower boundaries of the formation region of interest may be determined. Typically, the wellbore 30 will be cased at least to the vicinity of the upper boundary 11 once it has been located. When the formation characteristics have been determined, the wellbore 30 may be plugged back with the cement plug 34 to the boundary 11 and the plug dressed off using a conventional rotary drilling bit such as the bit 40 at the end of a conventional drillstem.

Figure 2:
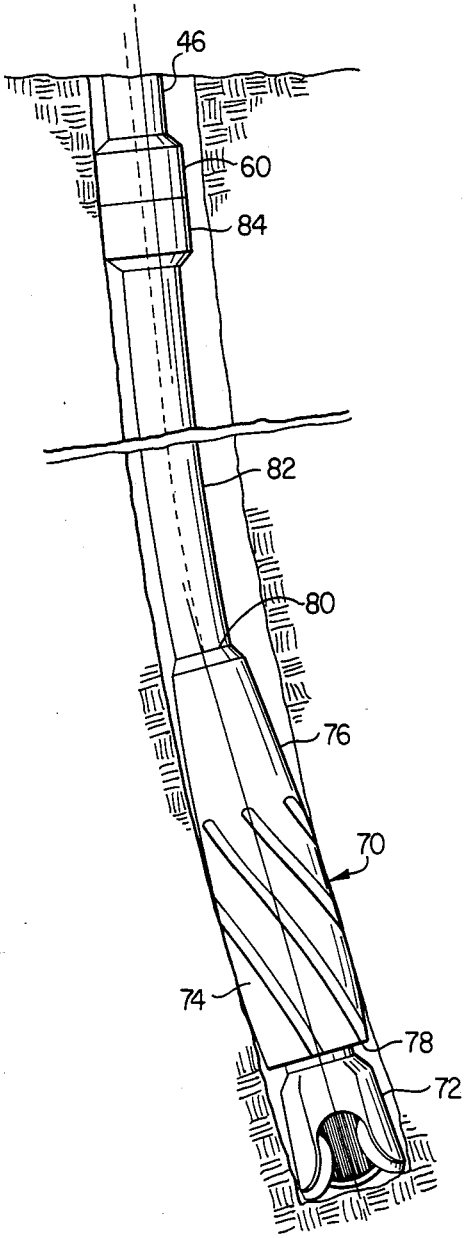
FIG. 2 is an elevation view of a downhole drilling assembly of a type advantageously used for drilling a curved wellbore with the system of the present invention.

The curved portion 36 of the wellbore may be "kicked off" and formed using a drilling assembly of the type illustrated in FIG. 2. Referring to FIG. 2, a rotary downhole drilling assembly or tool 70 is illustrated and includes a conventional rotary drillbit 72 similar to the bit 40 and a unique stabilizer tool or body 74. The stabilizer body 74 is directly connected to the bit 72 and comprises a tapered outer surface 76 having a somewhat convex curvature and tapering from the end 78 toward the end 80. The end 80 of the stabilizer body 74 is connected to a relatively flexible tubular section 82 having a box joint portion 84 whereby the tool 70 may be connected to one of the drillstem sections 46. The tool 70 is adapted to drill the curved wellbore section 36 through rotation of the drillstem system 39 until the wellbore reaches a generally horizontal direction whereby the tool 70 may be replaced with a tool comprising the bit 40 and stabilizer body 42. Circulation of drilling fluids may be carried out in a conventional manner through the drillstem system 39 to the bit 40 and upward through the wellbore annulus.

Alternatively, certain types of downhole drill motors may be employed which do not require constant rotation of the drillstem, including types commercially available from Norton Christensen, Inc., of Salt Lake City, Utah. Still further, wellbore drilling assemblies such as of the type described in U.S. Pat. No. 4,523,652 to Frank J. Schuh and assigned to the assignee of the present invention may be employed to form the curved portion 36 of the wellbore.

The drillstem assembly used for forming the curved portion 36 of the wellbore will comprise a sufficient number of drillpipe sections 46 to complete the curved portion and the desired horizontally extending portion 33 while the weight adding drillstem sections 50 and 52 are used as required in the vertical portion 31 of the wellbore. The measurement-while-drilling unit 48 may be added to the drillstem system 39 during formation of the curved portion 36 of the wellbore and used throughout the remainder of the drilling operation in order to determine when the wellbore has reached the horizontal direction and to provide for guidance of the horizontal extent of the wellbore.

Once the wellbore has reached its maximum angular extent and it is decided to extend the wellbore horizontally, the drilling assembly 70 or a similar curved wellbore drilling motor is replaced with the drilling assembly comprising the bit 40 and the stabilizer 42 whereupon the continuing formation of the wellbore is carried out by rotation of the drillstem from the drilling rig 14. Alternatively, downhole rotary motors may be employed which provide for correcting and holding a direction of the horizontal wellbore portion. Such motors typically require limited rotation of the drillstem when holding a particular direction while maintaining the drillstem in a nonrotatable mode during correction of the direction of the wellbore or if a change in direction is desired. Thanks to the provision of the unique drillpipe sections 46, and the arrangement of the weight adding drill collars 50 and drillstem members 52 "uphole" or in the vertical portion of the wellbore, the drillstem is maintained biased against the radially outer most wall portion 37 of the curved portion 36 of the wellbore to minimize the formation of an irregular cross-sectional shape of the wellbore and to minimize the chance of sticking the drillstem in the wellbore upon withdrawal therefrom. Certainly, the provision of the unique compressively stressed drillpipe sections 46 is important to the overall method and system of the present invention.

Although preferred embodiments of the present invention have been described herein in detail, those skilled in the art will recognize that the improved method and system described herein may be subject to various modifications and substitutions without departing from the scope and spirit of the invention as recited in the appended claims.

What is claimed is:

1. A method for drilling a deviated wellbore characterized by a generally vertical wellbore portion contiguous with a curved wellbore portion having a radius of curvature of about 200 feet to 400 feet and a further wellbore portion extending to the bottom of the wellbore and through a formation region of interest configured in such a way that the wellbore is drilled into the formation region of interest from the kick-off point of the deviated portion of the wellbore,said method comprising the steps of:

forming said vertical wellbore portion;

providing a drillstem including a first drillstem portion for drilling said curved wellbore portion and for extension within said curved wellbore portion comprising elongated elastically bendable sections of drillpipe each comprising a generally tubular member having joint forming portions at opposite ends thereof for connecting said sections of drillpipe end to end, and a plurality of spaced apart sleeves of a diameter greater than said tubular member and adapted for engagement with the wall of said curved wellbore portion for reducing the rotational drag on said first drillstem portion during the rotation thereof and for distributing the bending stresses on said first drillstem portion in said curved wellbore portion;

providing drilling tool means at a distal end of said first drillstem portion for drilling said curved wellbore portion;

providing a second drillstem portion remaining in said vertical wellbore portion characterized by end to end connected drillstem sections which are heavier per unit length than said sections of drillpipe extending through said curved wellbore portion so as to place sufficient weight on said sections of drillpipe extending through said curved wellbore portion to urge said first drillstem portion into engagement with the radially outermost portion of said wellbore through said curved wellbore portion during the formation thereof; and forming said curved wellbore portion and said further wellbore portion with said sections of drillpipe making up said drillstem in said curved wellbore portion and said further wellbore portion, respectively, while urging said first drillstem portion into engagement of at least some of said sleeves with said radially outermost portion of said curved wellbore portion.

2. The method set forth in claim 1 including the step of:

extending said further wellbore portion generally horizontally beyond said curved wellbore portion by providing drilling means for frilling said further wellbore portion in a predetermined direction and by selectively rotating said drillstem to maintain the directional attitude of said drilling means, and providing sufficient drillstem length made up of said sections of drillpipe connected end to end to extend through said curved wellbore portion and said further wellbore portion during formation of said further wellbore portion.

3. The method set forth in claim 1 wherein:

the step of drilling said curved wellbore portion comprises rotating said drillstem including first drill stem portion extending into said curved wellbore portion.

4. The method set forth in claim 3 wherein:

said drilling tool means is characterized by rotatable bit means and drillstem stabilizer means interposed in said drillstem between said bit means and said sections of drillpipe, said stabilizer means including a body having a tapered exterior surface having a radius of curvature conforming substantially to the radius of curvature of said wellbore, and said step of forming said curved wellbore portion is carried out by rotating said drillstem and said drilling tool means.

5. A method for drilling a well into a relatively low permeability hydrocarbon reservoir such as limestone, wherein a wellbore is formed which is characterized by a generally vertical wellbore portion contiguous with a curved wellbore portion extending within said reservoir and having a radius of curvature of about 200 feet to 400 feet and a further wellbore portion extending within said reservoir, said curved wellbore portion and said further wellbore portion being drilled in an open hole condition, said method comprising the steps of:

forming said vertical wellbore portion;

providing a drillstem and drilling tool means at a distal end of said drillstem for drilling a curved wellbore portion using at least a portion of said drillstem between the surface and said drilling tool means and characterized by end to end connected sections of drillpipe which are elastically bendable for extending said drillstem through said curved wellbore portion, said elastically bendable sections of drillpipe each including a cylindrical pipe body and a plurality of spaced apart sleeve portions having a diameter greater than said pipe body;

providing a portion of said drillstem remaining in said vertical wellbore portion characterized by end to end connected drillstem sections which are heavier per unit length than said sections of drillpipe extending through said curved wellbore portion so as to place sufficient weight on said sections of drillpipe extending through said curved wellbore portion to urge said drillstem into engagement with the radially outermost portion of said wellbore through said curved wellbore portion during the formation thereof; and forming said curved wellbore portion and said further wellbore portion with said sections of drillpipe making up said drillstem in said curved wellbore portion and said further wellbore portion, respectively, by urging said sleeve portions into engagement with the radially outermost surfaces of said curved wellbore portion during formation of said curved wellbore portion and said further wellbore portion, respectively.

* * * * *